United States Patent [19]

Tuma

[11] Patent Number: 4,876,813

[45] Date of Patent: Oct. 31, 1989

[54] MAGAZINE FOR FIREARMS

[75] Inventor: Martin Tuma, Solothurn, Switzerland

[73] Assignee: ITM Industrial Technology & Machines AG, Solothurn, Switzerland

[21] Appl. No.: 280,988

[22] Filed: Dec. 7, 1988

[51] Int. Cl.[4] ..... F41C 25/04

[52] U.S. Cl. ..... 42/50

[58] Field of Search ..... 42/50, 22, 18, 7

[56] References Cited

U.S. PATENT DOCUMENTS

| | | | |
|---|---|---|---|
| 1,291,688 | 1/1919 | Rosebush | 42/18 |
| 1,365,234 | 1/1921 | Eickhoff | 42/50 |
| 1,462,972 | 7/1923 | Lewis | 42/50 |
| 1,833,862 | 11/1931 | Schmeisser | 42/50 |
| 3,952,441 | 4/1976 | Tant | 42/50 |
| 4,589,218 | 5/1986 | Teppa | 42/50 |

*Primary Examiner*—Charles T. Jordan

*Attorney, Agent, or Firm*—Ladas & Parry

[57] ABSTRACT

The magazine, which is usable specifically for hand guns, is capable of storing cartridges of various sizes, i.e. diameters. The magazine lips are bent inwards with such a curvature that their inner surface defines part of a jacket of a cylinder, which has a diameter which corresponds substantially to the diameter of the base of the largest cartridge which the magazine can store. The uppermost edges of these magazine lips extend at an angle relative to each other such that they diverge in the firing direction of the magazine. The distance between these edges is at any point along their extent smaller than the diameter of the smallest cartridge which can be stored in the magazine. A spring biassed feeder within the magazine has a cartridge support surface, which includes a bulged surface section. This bulged surface section ensures a line contact with any size cartridge or shell, respectively, which is stored in the magazine. Accordingly, a cartridge which is loaded into the chamber of the gun is guided by two diverging fixed guides, namely the upper edges of the lips and one movable guide. This allows a handling of cartridges of various sizes without a jamming when loading.

4 Claims, 1 Drawing Sheet

MAGAZINE FOR FIREARMS

BACKGROUND OF THE INVENTION

1. Field of the Invention

The present invention relates to a magazine for firearms, specifically hand guns, which magazine is intended for a storing of cartridges of various sizes and includes a housing having two narrow side walls and two broad side walls, latter terminating at the open end of the magazine at magazine lips, and includes further a feeder having a cartridge supporting surface and a magazine spring biasing the feeder towards said open end of the magazine.

2. Description of the Prior Art

Firearms, specifically hand guns, such as pistols, are commonly provided with a magazine in which a number of cartridges are stored, which magazine is usually inserted in the pistol grip of such gun. In order to operate with the various sizes or calibers, respectively, of cartridges, it is common practice to design a frame including the operating mechanisms of a gun such that the barrel as well as the magazine may be exchanged dependent upon the prevailing cartridges to be fired by such gun. For manufacturing and cost reasons it would be obviously desirable to have barrels and magazines which could operate with various calibers and cartridge designs. It is specifically burdensome when a barrel can be used for various kinds of cartridges having slugs of the same caliber but which differ with regard to the design of the shell, because also in such case every size and kind of cartridge necessitates a different kind of a magazine. There is no prior art regarding magazines of firearms which can operate with various kinds of cartridges.

SUMMARY OF THE INVENTION

It is, therefore, a general object of the present invention to provide a magazine for firearms, specifically hand guns, which magazine can operate safely with various sizes and designs of cartridges.

A further object is to provide a magazine for firearms, specifically hand guns, in which the magazine lips comprise inner surfaces defining together parts of a jacket of a cylinder having a diameter substantially equal to the diameter of the base of the largest cartridge which is storable in the magazine, and which lips have further elongated edges extending at an angle relative to each other and at any point along their longitudinal extent at a mutual distance which is smaller than the diameter of the base of the smallest cartridge which is storable in the magazine; and having a cartridge support surface on the feeder which comprises a bulged surface section which ensures a line contact between the feeder and any cartridge shell supported thereupon.

A further object is to provide a magazine which has a feeder which includes a face surface pointing in the firing direction of a loaded cartridge and includes two side surfaces and two curvilinearly extending transition surfaces extending from either side of the face surface to one respective side surface, wherein the narrow magazine side wall pointing in the firing direction is adjoined at both sides by a curvilinearly extending coaxially to a respective adjacent feeder transition surface towards the respective broad magazine side wall.

Still a further object is to provide a magazine which has a cartridge guideway of a V-shaped cross section extending along either broad side wall in the longitudinal direction of the magazine and projecting towards the inside thereof, wherein the respective magazine wall area forming the flank of the respective V-shaped cartridge guideway which is located at its firing direction side extends curvilinearly at least at its edge area at the open end of the magazine and passes continuously curved into the narrow side wall located at the firing direction side of the magazine A further object is to provide a magazine in which the elongated lip edges extend at such an angle relative to each other that they diverge in the firing direction of the magazine.

A further object is to provide a magazine in which the elongated edges of the two lips diverge in the firing direction of the magazine, whereby a cartridge which is loaded from the magazine into the chamber of the gun is guided by two fixed guides and one movable guide which is spring biassed thereagainst.

BRIEF DESCRIPTION OF THE DRAWING

The present invention will be better understood and objects other than those set forth above will become apparent when consideration is given to the following detailed description thereof. Such description makes reference to the annexed drawing, wherein.

DESCRIPTION OF THE PREFERRED EMBODIMENT

Figure 1:
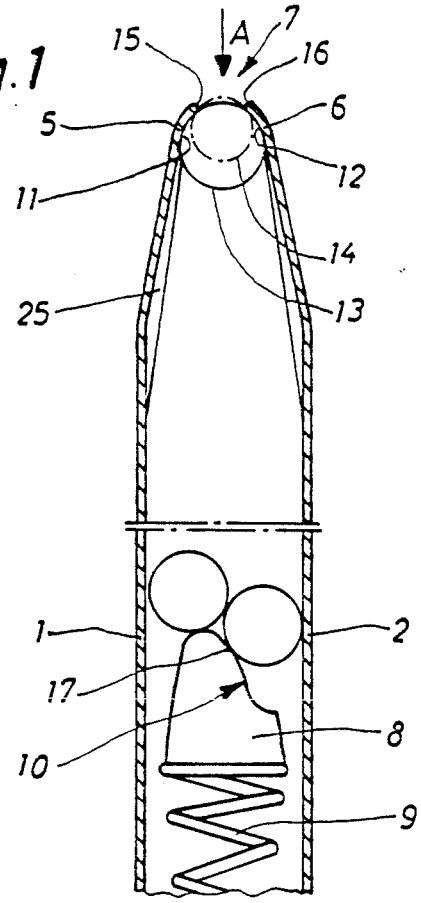
FIG. 1 illustrates schematically a section of a magazine along line I—I of FIG. 2.

The housing of the magazine has a first broad side wall 1 and a second broad side wall 2, located oppositely thereto, and, furthermore a narrow side wall 3, located at the firing direction side of the magazine, and, finally a rear narrow side wall 4. The broad side walls 1, 2 terminate at the well-known magazine lips 5,6, which are generally bent inwards such to keep the uppermost cartridge in place. The two magazine lips 5, 6 are located at the open end 7 of the magazine. A feeder 8 is located within the housing of the magazine, which feeder 8 is acted against by the magazine spring 9, which urges the feeder 8 upwards towards the open end 7 of the magazine. The feeder 8, which may be a solid block or a hollow block, is provided with a cartridge supporting surface 10.

The inner surfaces 11, 12 of the two magazine lips 5, 6 are bent with such a curvature that these inner surfaces 11, 12 define together parts of a jacket of a cylinder, which has a diameter that is at least similar to the diameter of the largest cartridge, which can be stored in this magazine. This cartridge is designed in a full line identified by the reference numeral 13. The smallest cartridge which can be stored in the same magazine is identified by the reference numeral 14 and illustrated with broken lines at the uppermost cartridge position of the magazine. The magazine lips 5, 6 terminate at edge sections 15, 16. These edge sections 15, 16 are located at a mutual distance from each other, which is smaller than the diameter of the base of the smallest cartridge, i.e. cartridge 14 illustrated with broken lines, which is storable in this same magazine.

It has been mentioned above that the feeder 8 has a cartridge supporting surface 10. This cartridge supporting surface 10 includes an outwards bulged surface section 17, as illustrated in FIG. 1. This bulged surface section 17 ensures a line contact between the feeder 8 and any size of cartridges, i.e. specifically cartridge shells supported thereupon.

Figure 2:
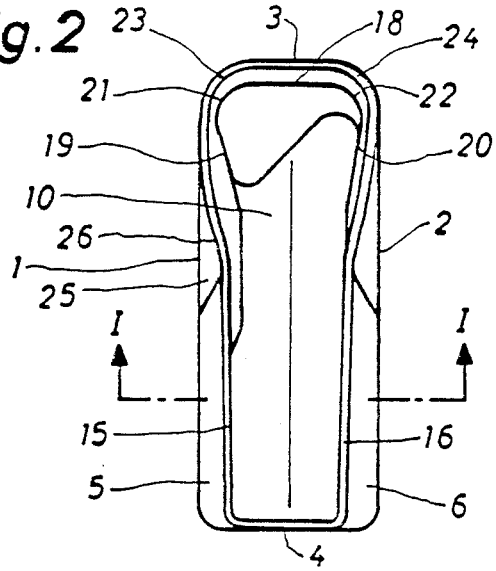
FIG. 2 is a view of the magazine of FIG. 1 in a section of the arrow A.

Considering specifically FIG. 2, it is apparent that the feeder 8 has a face surface 18, pointing in the firing direction, and furthermore two side surfaces 19 and 20. Side surface 19 continues into a curvilinearly extending transition surface 21, extending up to the face surface 18. Likewise side surface 20 is followed by a curvilinearly extending transition surface 22, which extends in turn to the face surface 18 of the feeder 8. Now, the narrow magazine side wall 3, which points in the firing direction, is adjoined at both sides by curvilinearly extending housing wall sections 23 and 24, respectively. Side wall section 23 extends coaxially to the feeder transition surface 21 and the curvilinearly extending housing wall section 24 extends coaxially to the feeder transition surface 22.

The magazine is provided with a cartridge guideway 25, having a V-shaped cross-section Such guideway is generally known in prior art magazines. However, the flank 26 (see FIG. 2) of these V-shaped guideways, which are provided on either side of the magazine which is located at the firing direction side of the V-shape extends curvilinearly at least at the upper edge area at the open side of the magazine and passes continuously curved into the narrow side wall 3 of the magazine which is located at the firing direction side thereof.

The magazine lips 5 and 6 terminate at edge sections 15 and 16. In contrast to all known designs in which these edge sections extend parallel to each other, the edges 15 and 16 extend at an angle relative to each other and specifically such that they diverge in the firing direction of the magazine. Accordingly, if now any kind, i.e. size of cartridge, specifically shell, stored in the magazine is loaded from the magazine into the chamber of the gun, such cartridge is guided by two fixed guides diverging from each other, namely the two edge sections 15 and 16 and, additionally, by a movable guide, namely the bulged surface section 17 of the cartridge supporting surface 10 of the feeder 8, which also is in line contact with the shell being loaded, where in addition this third movable guide is spring biased against the cartridge by the magazine spring 9.

With a magazine as described above, it is now possible to use one and the same magazine for different kinds and sizes of cartridges. As example it may be stated that the magazine can operate with cartridges of the sizes caliber 9 mm Para, caliber 0.41 as well as caliber 9 mm Action Express. Practical tests have proven, that no jamming whatsoever occurs when using this magazine together with cartridges of various sizes.

While there is shown and described a present preferred embodiment of the invention, it is to be distinctly understood that the invention is not limited thereto, but may be otherwise variously embodied and practiced within the scope of the following claims

I claim:

1. A magazine for a firearm specifically a hand gun, the magazine being for storing cartridges of various sizes and comprising:

a housing having two narrow side walls and two broad side walls, the latter terminating at an open end of the housing in magazine lips, cartridge guidewave of a V-shaped cross section respectively extending along said broad side walls in a longitudinal direction of said housing and projecting towards the inside thereof, respective housing wall areas forming flanks of the respective V-shaped cartridge guideways which, at a firing direction side, extend curvilinearly at least at edge areas at said open end of said housing and pass continuously curved into the said narrow side wall at the firing direction side, and a feeder having a cartridge support surface and a magazine spring biasing said feeder towards said open end of said housing;

said magazine lips each comprising an inner surface defining part of a jacket of a cylinder having a diameter substantially equal to the diameter of the base of the largest cartridge which is storable in the magazine, and elongated edges extending at an angle relative to each other and at any point along their longitudinal extent at a mutual distance which is smaller than the diameter of the base of the smallest cartridge which is storable in the magazine;

and said cartridge support surface of said feeder comprising a bulged surface section which ensures a line contact between said feeder and any cartridge shell supported thereupon.

2. The magazine of claim 1, said feeder including a face surface pointing in the firing direction, two side surfaces and two curvilinearly extending transition surfaces extending form either side of said face surface to one respective side surface;

wherein the narrow magazine side wall pointing in the firing direction is adjoined at both sides by a curvilinearly extending housing wall section extending coaxially to a respective adjacent feeder transistion surface towards the respective broad magazine side wall.

3. The magazine of claim 1, wherein said elongated lip edges extend at such an angle relative to each other that they diverge in the firing direction of the magazine.

4. The magazine of claim 1, wherein said elongated edges of said two lips diverge in the firing direction of the magazine, whereby a cartridge which is loaded from the magazine into the chamber of the gun is guided by two fixed guides and one movable guide which is spring biased thereagainst.

* * * * *